US011492765B2

(12) United States Patent
Ishida et al.

(10) Patent No.: US 11,492,765 B2
(45) Date of Patent: Nov. 8, 2022

(54) CONSTRUCTION VEHICLE

(71) Applicant: SAKAI HEAVY INDUSTRIES, LTD., Tokyo (JP)

(72) Inventors: Shinji Ishida, Saitama (JP); Kenta Toyoshima, Saitama (JP)

(73) Assignee: SAKAI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/963,235

(22) PCT Filed: Dec. 12, 2018

(86) PCT No.: PCT/JP2018/045618
§ 371 (c)(1),
(2) Date: Jul. 19, 2020

(87) PCT Pub. No.: WO2019/142551
PCT Pub. Date: Jul. 25, 2019

(65) Prior Publication Data

US 2021/0047790 A1 Feb. 18, 2021

(30) Foreign Application Priority Data

Jan. 19, 2018 (JP) ..... JP2018-007195

(51) Int. Cl.
*E01C 19/28* (2006.01)
*B06B 1/16* (2006.01)
(Continued)

(52) U.S. Cl.
CPC ..... *E01C 19/286* (2013.01); *B06B 1/16* (2013.01); *F02B 63/00* (2013.01); *F02D 31/001* (2013.01); *F15B 11/00* (2013.01)

(58) Field of Classification Search
CPC ..... E01C 19/28; E01C 19/281; E01C 19/283; E01C 19/285; E01C 19/286; E01C 19/23;
(Continued)

(56) References Cited

U.S. PATENT DOCUMENTS

2007/0119163 A1 5/2007 Tatsuno et al.
2007/0193262 A1 8/2007 Iwamoto
2009/0217654 A1 9/2009 Iwamoto

FOREIGN PATENT DOCUMENTS

CN 101002010 7/2007
JP 2003214355 7/2003
(Continued)

OTHER PUBLICATIONS

Machine Translation of JP2005279363A PDF file name: "JP2005279363A_Machine_Translation.pdf" (Year: 2005).*
(Continued)

*Primary Examiner* — Grant Moubry
*Assistant Examiner* — Ruben Picon-Feliciano
(74) *Attorney, Agent, or Firm* — CRGO Global; Steven M. Greenberg

(57) ABSTRACT

Provided is a construction vehicle including: a rolling-use hydraulic pump coupled to an output shaft of an engine and supplying hydraulic oil to a rolling-use hydraulic circuit; a task-use hydraulic pump coupled to the output shaft of the engine and supplying the hydraulic oil to a task-use hydraulic circuit; and an overspeed suppression mechanism configured to activate the task-use hydraulic pump to suppress overspeed of the engine when a load equal to or greater than allowable rotation speed is applied from the rolling-use hydraulic pump to the output shaft of the engine.

6 Claims, 7 Drawing Sheets

(51) Int. Cl.

| | |
|---|---|
| ***F02B 63/00*** | (2006.01) |
| ***F02D 31/00*** | (2006.01) |
| ***F15B 11/00*** | (2006.01) |

(58) Field of Classification Search
CPC ... F02B 63/00; B60W 10/30; B60W 30/1886; B60Y 2200/413
See application file for complete search history.

(56) References Cited

FOREIGN PATENT DOCUMENTS

| | | | |
|---|---|---|---|
| JP | 2005106170 | | 4/2005 |
| JP | 2005279363 | | 10/2005 |
| JP | 2005279363 A | * | 10/2005 |
| JP | 2011194978 A | * | 10/2011 |
| JP | 2013217421 | | 10/2013 |

OTHER PUBLICATIONS

Machine Translation of JP 2011194978 A PDF file name: "JP2011194978A_Machine_Translation.pdf" (Year: 2011).*
Office Action, Intellectual Property Office of PRC, dated Jul. 21, 2021.

* cited by examiner

CONSTRUCTION VEHICLE

CROSS-REFERENCE TO RELATED APPLICATIONS

This application is a § 371 national phase entry of International Application No. PCT/JP2018/045618, filed Dec. 12, 2018, which claims priority to Japanese Patent Application No. 2018007195, filed Jan. 19, 2018.

TECHNICAL FIELD

The present invention relates to a construction vehicle.

BACKGROUND ART

Patent Literature 1 discloses a construction vehicle to roll and stop with use of a hydro Static transmission (HST).

CITATION LIST

Patent Literature

Patent Literature 1: Japanese Patent Application Publication No. 2005-279363

SUMMARY OF THE INVENTION

Problems to be Solved

When the construction vehicle rolls on a downhill when being deadheaded or the like or is stopped (returning a forward-backward lever to the neutral position) with use of the HST on a downhill, fall energy of the vehicle may be greater than engine brake power. Accordingly, there is a risk that rotation speed of an engine is excessively increased. Overspeed more than allowable rotation speed of the engine may cause valve surging, resulting in that valves, rocker arms, or the like may be damaged, and the vehicle cannot be operated. Further, damage to the engine at that time is severe, and repair costs are also high.

To prevent overspeed of the engine on a downhill, it is desirable to set a vehicle speed transmitter to low speed. However, there is a limit to rely on human operations because the operator may forget a switching operation when the vehicle rolls on a downhill at the time of being deadheaded. If the vehicle speed transmitter is automatically switched to the low speed, a discharge amount of hydraulic oil is switched during high rotation speed, which applies a high load to a rolling-use motor, to have the rolling-use motor itself likely damaged. Automatically applying braking means sudden braking unanticipated for the operator to presumably give an overload to the operator.

There are ways, which does not require a special operation, such as selecting an engine having larger engine brake power or employing reinforced valve springs. However, it is unpractical to mount an engine, having a larger displacement than required, for engine brake power. Further, cooperation of an engine manufacturer is essential for modifications of internal components in an engine or an addition of exhaust braking, and the like. In recent circumstances where exhaust gas regulations are strict, it is not possible to easily modify a configuration. It is conceivable to mount a service brake, a retarder, or the like to a vehicle. However, from a viewpoint of a mounting location or costs, it is difficult to adapt additional braking, except a case where the adaptation is sufficiently considered since an initial stage of development.

The present invention is provided to solve the problems described above, and an object of the present invention is to provide a construction vehicle having a simple configuration to suppress overspeed of the engine.

Solution to Problem

To solve the problem described above, the present invention provides a construction vehicle including: a rolling-use hydraulic pump coupled to an output shaft of an engine and supplying hydraulic oil to a rolling-use hydraulic circuit; a task-use hydraulic pump coupled to the output shaft of the engine and supplying the hydraulic oil to a task-use hydraulic circuit; and an overspeed suppression mechanism configured to activate the task-use hydraulic pump to suppress overspeed of the engine when a load equal to or greater than allowable rotation speed is applied from the rolling-use hydraulic pump to the output shaft of the engine.

According to the configuration described above, the task-use hydraulic pump is activated to consume power as startup energy so that power input to the engine is reduced, with the result that overspeed of the engine can be suppressed. Further, activating the existing task-use hydraulic pump is enough to solve the problem so that the construction vehicle can have a simple configuration.

Further, the construction vehicle preferably includes a drum having an eccentric shaft therein and configured to compact a compacted surface, wherein the task-use hydraulic pump rotates the eccentric shaft to vibrate the drum.

A type of the task-use hydraulic pump may be selected appropriately. According to the configuration described above, large energy is required when the drum is vibrated. The large energy is consumed by the task-use hydraulic pump so that the overspeed of the engine can be efficiently suppressed.

Further, the overspeed suppression mechanism preferably rotates the eccentric shaft intermittently in the same direction. Still further, the overspeed suppression mechanism preferably rotates the eccentric shaft in a normal direction and a reverse direction. According to the configuration described above, when the construction vehicle rolls on a long or a steep downhill, for example, the overspeed is efficiently suppressed.

Further, the allowable rotation speed is preferably set higher than the maximum rotation speed of the engine when the vehicle rolling at high idling is stopped. According to the configuration described above, when the rotation speed is within a range normally used, the task-use hydraulic pump is prevented from being activated by the overspeed suppression mechanism.

Further, the overspeed suppression mechanism preferably stops the task-use hydraulic pump when the overspeed of the engine is suppressed and rotation speed of the engine is equal to or less than a predetermined rotation speed, and the predetermined rotation speed is set higher than rotation speed at high idling of the engine.

When the task-use hydraulic pump is in operation for a long time, an originally unintended operation (vibration, for example) continues. However, according to the configuration described above, the task-use hydraulic pump is stopped so that the unintended operation is prevented. Further, setting a lower limit value to stop the task-use hydraulic pump higher than the rotation speed at high idling causes the task-use hydraulic pump to be securely stopped.

Advantageous Effects of the Invention

The construction vehicle of the present invention suppresses overspeed of the engine with a simple configuration.

EMBODIMENTS OF THE INVENTION

Figure 1:
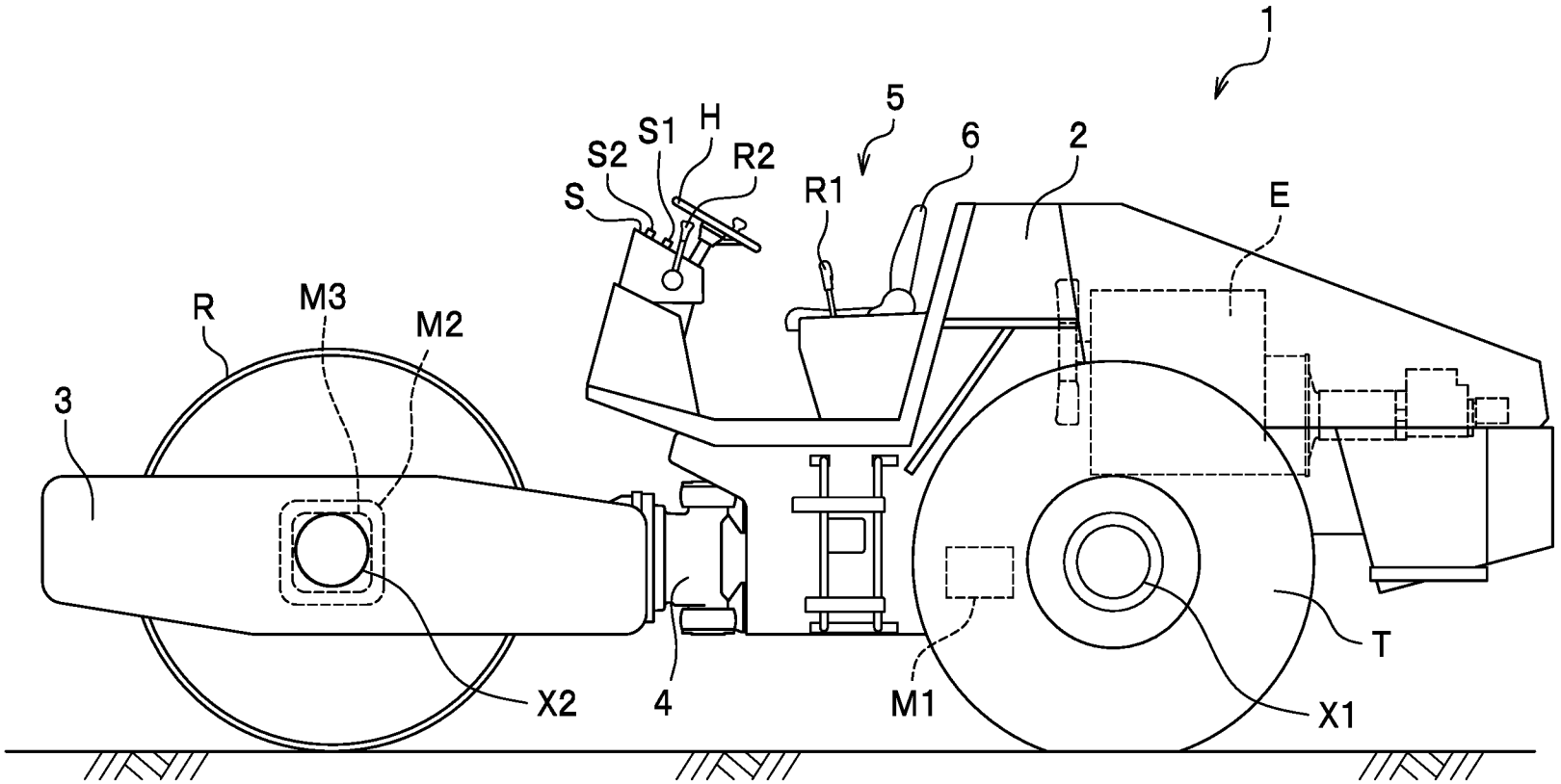
FIG. 1 is a side view of a vibrating roller according to an embodiment of the present invention.

A description will be given of an embodiment of the present invention in detail with reference to the accompanying drawings. FIG. 1 shows a vibrating roller 1 for construction as a construction vehicle according to the present embodiment. The vibrating roller 1 is a compactor having a vibration drum R. The vibrating roller 1 moves forward or backward while vibrating the drum R to compact a compacted surface. The present embodiment shows the vibrating roller 1 as a construction vehicle, but the present invention may be applied to other construction vehicles used at a construction site.

Figure 2:
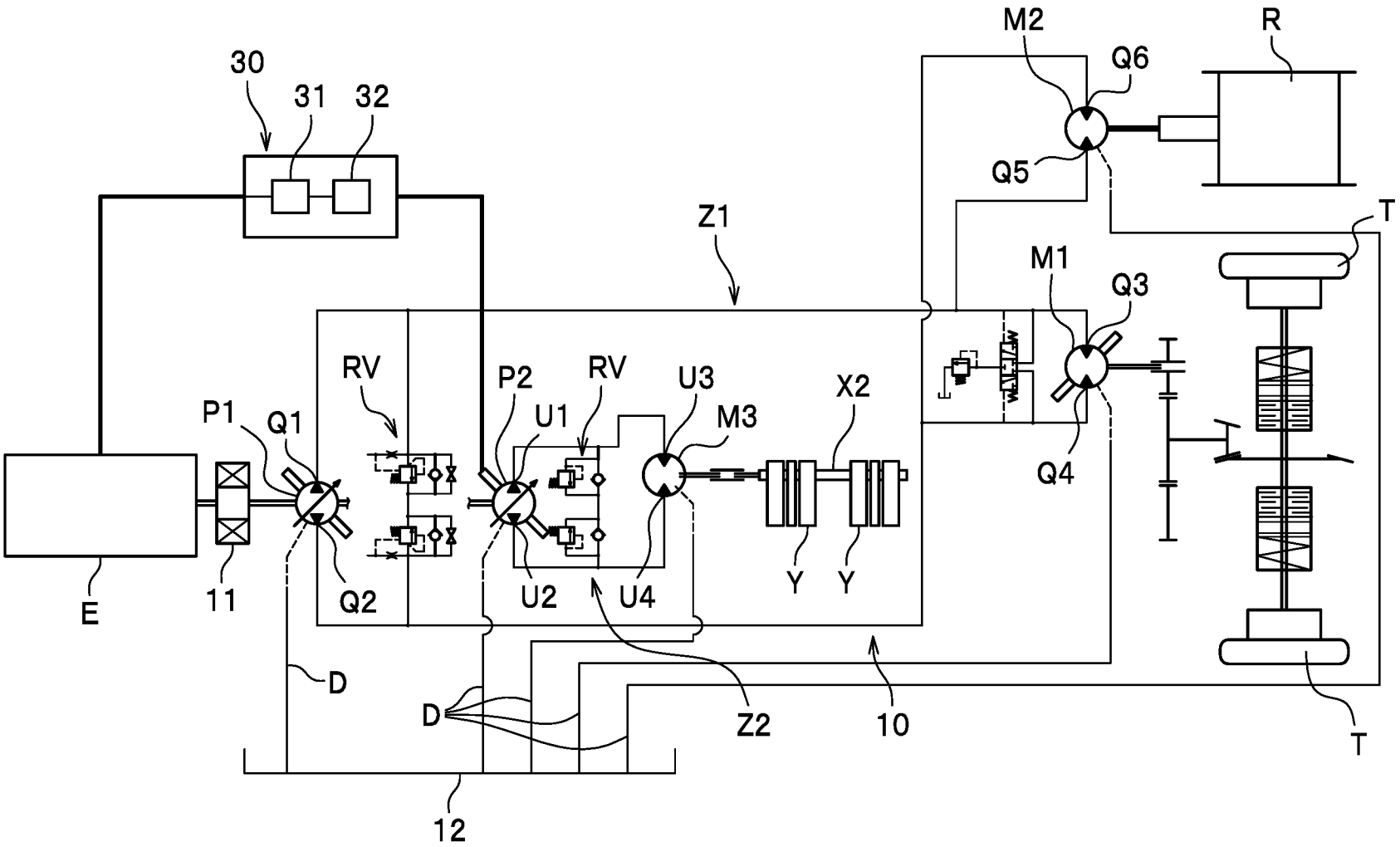
FIG. 2 is a schematic diagram of a hydraulic device of the vibrating roller of the present embodiment.

As shown in FIG. 1, the vibrating roller 1 mainly includes a base 2, tires T, a tire motor M1, a machine frame 3, the drum R, a drum motor M2, a vibration-use hydraulic motor M3, a hydraulic device 10 (see FIG. 2), and an overspeed suppression mechanism 30 (see FIG. 2). The tire motor M1, drum motor M2, and vibration-use hydraulic motor M3 are hydraulic motors.

As shown in FIG. 1, the base 2 includes an engine E and rotatably supports the tires T via an axle X1. A driver's seat 5 with a steering wheel H is provided on an upper part of the base 2. A forward-backward lever R1 is provided aside of a seat 6 of the driver's seat 5. The forward-backward lever R1 is a lever to switch between a forward movement and backward movement of the vehicle. The forward-backward lever R1 is configured to position at three positions: a forward movement position, a neutral position, and a backward movement position. A throttle lever R2 is provided aside of an operation panel S of the driver's seat 5. The throttle lever R2 is a lever to control speed of the engine E in accordance with a tilting angle.

The operation panel S includes a vibration switch S1 to switch between on and off for vibrating the drum R and a changeover switch S2 to switch between normal rotation and reverse rotation of the vibration. The tire motor M1 is provided in the vicinity of the axle X1 supporting the tires T.

The machine frame 3 is coupled to the base 2 via a coupling part 4. The vibrating roller 1 is of an articulated type which is pivotable about the coupling part 4, around the vertical axis. The machine frame 3 supports the drum R so as to be rotated and vibrated. A vibrator case is provided inside the drum R and includes an eccentric shaft X2 therein, which causes the drum R to vibrate. The eccentric shaft X2 fixed with eccentric weights Y (see FIG. 2) is rotated by the vibration-use hydraulic motor M3 to vibrate the drum R. The drum motor M2 and vibration-use hydraulic motor M3 are mounted inside the drum R.

Though a specific illustration is omitted, the vibrating roller 1 includes an HST brake for a task and rolling. The vibrating roller 1 further includes a parking brake to be used for parking. Note that the present invention may be adapted to a rigid frame type roller in place of an articulated type roller, and may be adapted to a tandem roller, a macadam roller, or the like.

As shown in FIG. 2, the hydraulic device 10 of the present embodiment includes a rolling-use hydraulic circuit Z1 forming a rolling-use hydraulic circuit, and a vibration-use hydraulic circuit Z2 forming a vibration-use hydraulic circuit. The rolling-use hydraulic circuit Z1 includes a rolling-use hydraulic pump P1, the tire motor M1, the drum motor M2, and channels coupling these devices with one another, to form a closed circuit.

The rolling-use hydraulic pump P1 is of a variable capacity type which can vary a discharge rate, to be coupled to the output shaft of the engine E via a shaft coupling 11. Further, a vibration-use hydraulic pump P2 is coupled to the output shaft of the engine E. That is, in the present embodiment, the rolling-use hydraulic pump P1 and vibration-use hydraulic pump P2 are coupled in series to the output shaft of the engine E so as to be rotated synchronously with each other. Note that the rolling-use hydraulic pump P1 and the vibration-use hydraulic pump P2 are directly coupled by a spline shaft in the present embodiment, but may be indirectly coupled via a gear or the like.

The rolling-use hydraulic pump P1 has a first port Q1 and a second port Q2. The first port Q1 is coupled to a first port Q3 of the tire motor M1 and a first port Q5 of the drum motor M2 via the channels, respectively.

The second port Q2 of the rolling-use hydraulic pump P1 is coupled to a second port Q4 of the tire motor M1 and a second port Q6 of the drum motor M2 via the respective channels. Hydraulic oil flows into the tire motor M1 to rotationally drive the tires T. The hydraulic oil flows into the drum motor M2 to rotationally drive the drum R. A flow direction of the hydraulic oil in the rolling-use hydraulic circuit Z1 can be switched by the rolling-use hydraulic pump P1. Thus, the tires T and the drum R can be rotated normally (forward) or reversely (backward).

The rolling-use hydraulic pump P1, the tire motor M1, and the drum motor M2 each have a drain channel D coupled to a hydraulic tank 12. Further, relief valves RV are provided in the rolling-use hydraulic circuit Z1, to prevent oil pressure from rising to a preset pressure or more.

The vibration-use hydraulic circuit Z2 includes the vibration-use hydraulic pump P2, the vibration-use hydraulic motor M3, and channels coupling these devices with one another, to form a closed circuit. The vibration-use hydraulic pump P2 has a first port U1 and a second port U2. The first port U1 is coupled to a first port U3 of the vibration-use hydraulic motor M3 via the channel. The second port U2 is coupled to a second port U4 of the vibration-use hydraulic motor M3 via the channel. The hydraulic oil flows into the vibration-use hydraulic motor M3, which is coupled to the eccentric shaft X2 to vibrate the drum R, to rotate the eccentric shaft X2. Relief valves RV are provided in the vibration-use hydraulic circuit Z2 to prevent oil pressure from rising to a setting pressure or more. A flow direction of the hydraulic oil in the vibration-use hydraulic circuit Z2 can be switched by the vibration-use hydraulic pump P2. Thus, the eccentric shaft X2 can be rotated normally or reversely.

As shown in FIG. 2, the overspeed suppression mechanism 30 is a mechanism to automatically suppress overspeed of the engine E. The overspeed suppression mechanism 30 mainly includes a sensor 31 to detect rotation speed of the engine E, and a determination unit 32. The overspeed suppression mechanism 30 is electrically connected to the engine E and the vibration-use hydraulic pump P2. The determination unit 32 mainly includes a calculation part, an input part, a storage part, a display part, and the like, and sends an activation signal or a stop signal to the vibration-use hydraulic pump P2 based on the rotation speed acquired by the sensor 31.

The storage part of the determination unit 32 stores an upper limit value to activate the vibration-use hydraulic pump P2 ("allowable rotation speed" in the appended claims), and a lower limit value to stop the vibration-use hydraulic pump P2 ("predetermined rotation speed" in the appended claims), preliminary set based on the rotation speed of the engine E detected by the sensor 31. When the detected rotation speed of the engine E is determined to be equal to or greater than the upper limit value, the determination unit 32 sends the activation signal to the vibration-use hydraulic pump P2. At this moment, even when the vibration switch S1 is OFF, the vibration-use hydraulic pump P2 is activated. Meanwhile, after the vibration-use hydraulic pump P2 is activated, when the detected rotation speed of the engine E is determined to be equal to or less than the lower limit value, the determination unit 32 sends the stop signal to the vibration-use hydraulic pump P2.

Next, a description will be given of a basic operation of the vibrating roller 1. When the operator activates the engine, and then shifts the throttle lever R2 and the forward-reverse lever R1, the rolling-use hydraulic pump P1 is activated. The hydraulic oil flows into the tire motor M1 and the drum motor M2 from the rolling-use hydraulic pump P1 to move the vehicle forward or backward.

When the operator turns on the vibration switch S1, the vibration-use hydraulic pump P2 is activated. The hydraulic oil flows into the vibration-use hydraulic motor M3 from the vibration-use hydraulic pump P2 to rotate the eccentric shaft X2 so as to vibrate the drum R. When the operator turns off the vibration switch S1, the vibration of the drum R is stopped.

Figure 3A:
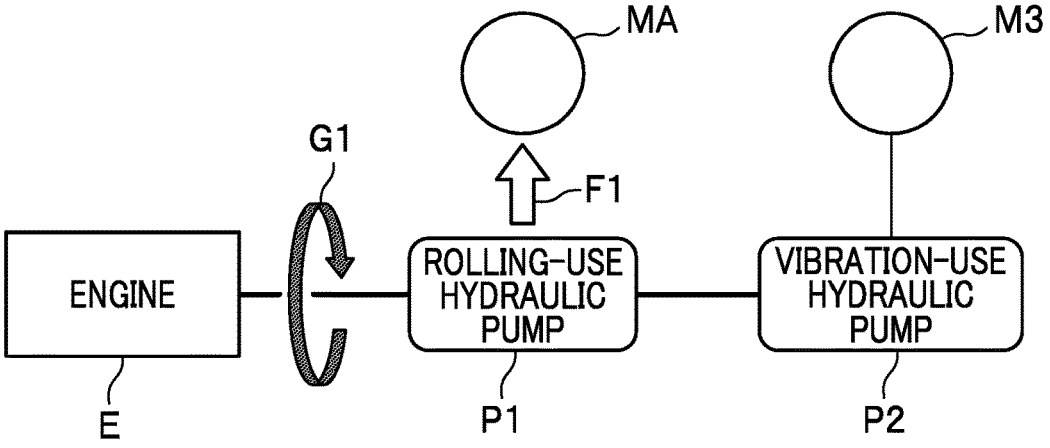
FIG. 3A is a conceptual diagram of a conventional vibrating roller when normally rolling, to illustrate a problem to be solved by the present invention.
Figure 3B:
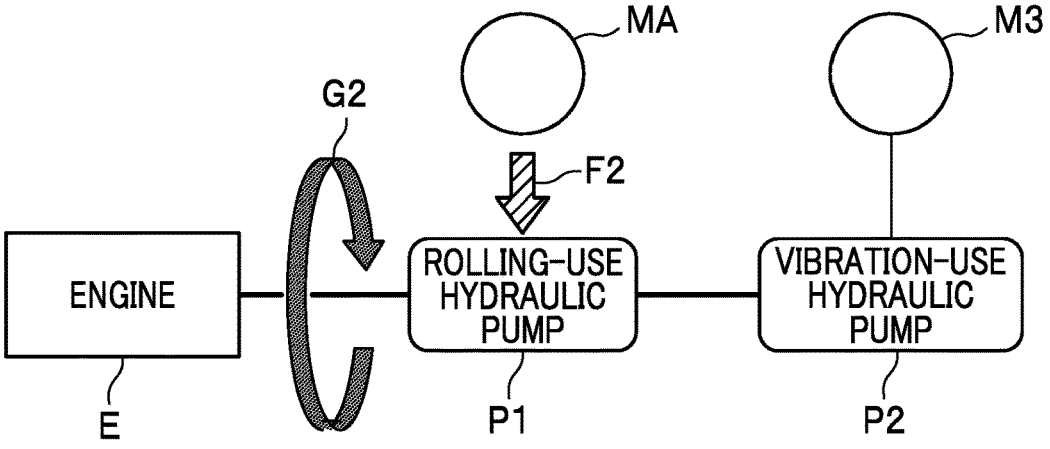
FIG. 3B is a conceptual diagram of the conventional vibrating roller having overspeed, to illustrate the problem to be solved by the present invention.

Next, a description will be given of advantageous effects of the overspeed suppression mechanism 30 with reference to FIGS. 3A to 3C. FIG. 3A is a conceptual diagram of a conventional vibrating roller when normally rolling, to illustrate a problem to be solved by the present invention. FIG. 3B is a conceptual diagram of the conventional vibrating roller having overspeed, to illustrate the problem to be solved by the present invention.

As shown in FIG. 3A, when the conventional vibrating roller is normally rolling, power is input from the engine E to the rolling-use hydraulic pump P1, and the rolling-use hydraulic pump P1 outputs the hydraulic oil to a rolling-use motor MA. An arrow F1 indicates an output from the rolling-use hydraulic pump P1 to the rolling-use motor MA. An arrow G1 indicates a load to the engine E.

Next, as shown in FIG. 3B, when the conventional vibrating roller rolls on a downhill, the power is input from the rolling-use motor MA to the rolling-use hydraulic pump P1 due to the fall of vehicle, to increase the rotation speed of the engine E by an amount which cannot be covered by engine brake power. This results in overspeed of the engine E to have a risk of the engine E being damaged. An arrow F2 indicates an output from the rolling-use motor MA to the rolling-use hydraulic pump P1. An arrow G2 indicates a state where the load to the engine E is increased.

Figure 3C:
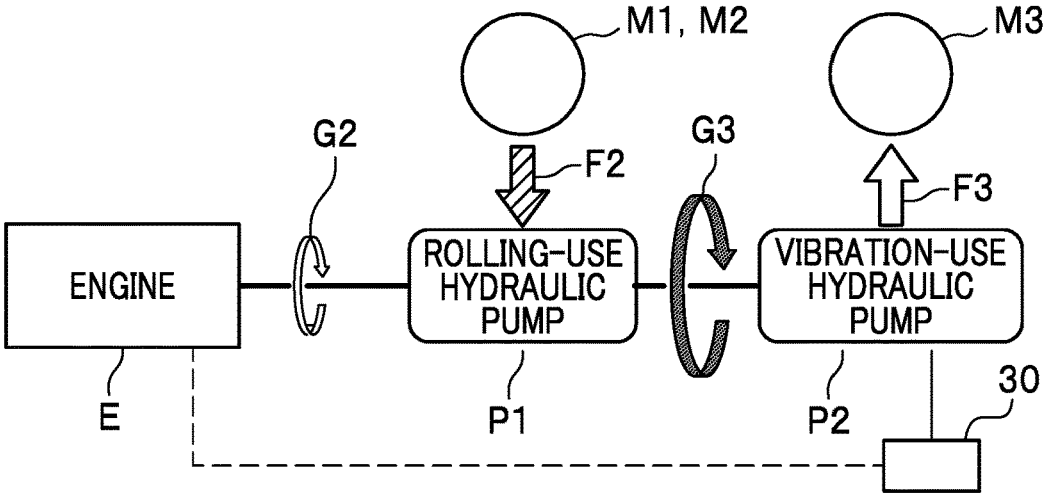
FIG. 3C is a conceptual diagram to illustrate advantageous effects of an overspeed suppression mechanism according to the present embodiment.

Meanwhile, according to the present embodiment shown in FIG. 3C, power is input from the tire motor M1 and the drum motor M2 to the rolling-use hydraulic pump P1 due to the fall of vehicle, but the vibration-use hydraulic pump P2 is activated by the overspeed suppression mechanism 30. Therefore, the power is consumed as startup energy for vibration so that power to be input to the engine E is reduced, and the overspeed of the engine E is suppressed. An arrow G3 indicates a state where the vibration-use hydraulic pump P2 is driven. An arrow G2 in FIG. 3C indicates a state where the load to the engine E is reduced.

Figure 4:
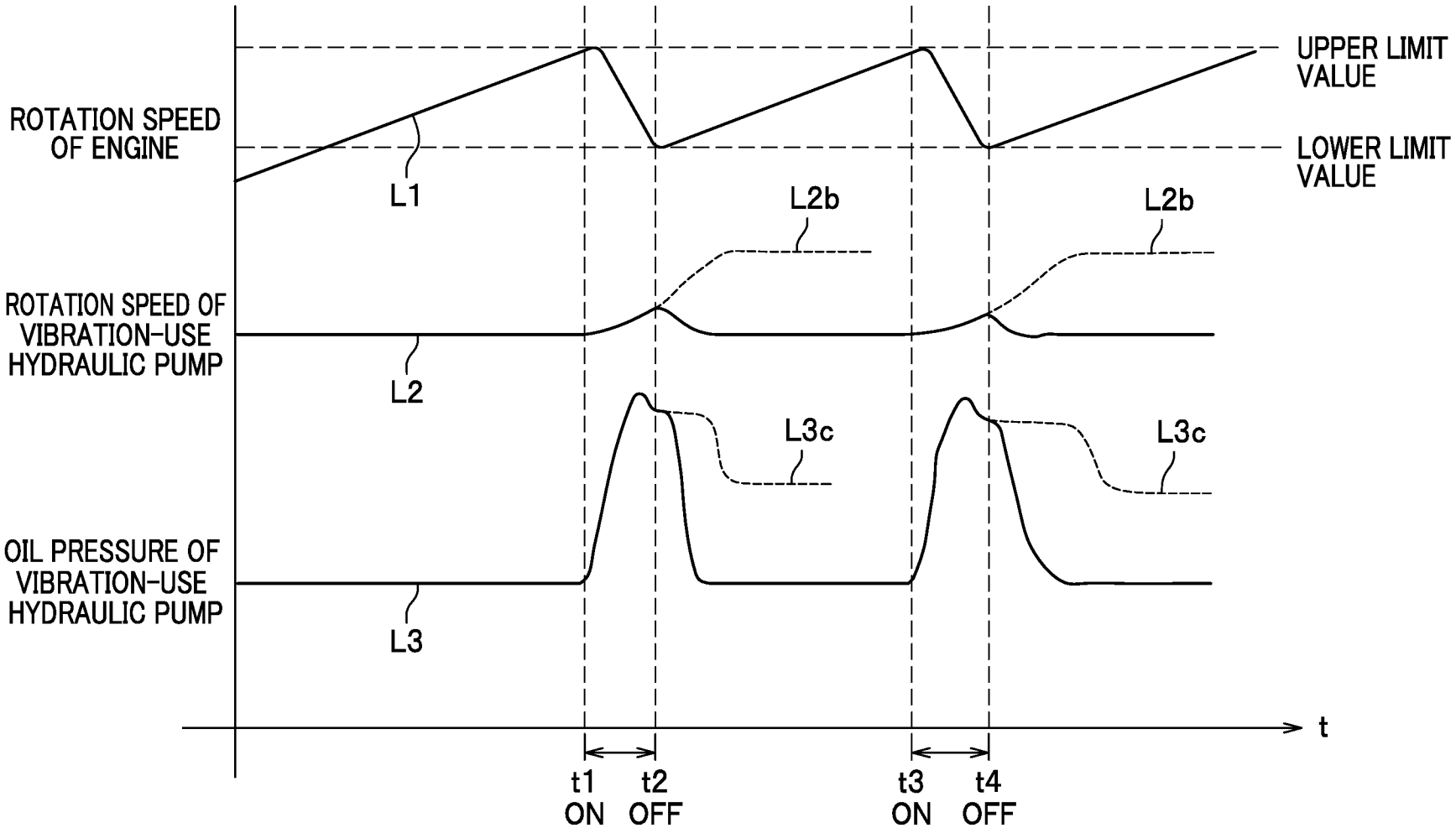
FIG. 4 is a graph chronologically showing rotation speed of the engine, rotation speed of a vibration-use hydraulic motor, and oil pressure of a vibration-use hydraulic pump.

FIG. 4 is a graph chronologically showing the rotation speed of the engine E, the rotation speed of the vibration-use hydraulic motor M3, and oil pressure of the vibration-use hydraulic pump P2. FIG. 4 schematically shows a state where the vibrating roller 1 rolls on a downhill, and the overspeed suppression mechanism 30 is activated. Here, when the rotation speed of the engine E reaches a predetermined upper limit value (time t1), the vibration-use hydraulic pump P2 is activated. Then, when the rotation speed of the engine E reaches a predetermined lower limit value (time t2), the vibration-use hydraulic pump P2 is stopped. The activation time of the vibration-use hydraulic pump P2 is about 1.5 seconds.

When the vehicle continues to roll on a downhill, and the rotation speed of the engine E reaches the upper limit value (time t3) again, the vibration-use hydraulic pump P2 is activated again. Thereafter, when the rotation speed of the engine E reaches the lower limit value (time t4), the vibration-use hydraulic pump P2 is stopped. The second activation time of the vibration-use hydraulic pump P2 is also about 1.5 seconds.

As shown with rotation speed L1 of the engine in FIG. 4, when the rotation speed of the engine E reaches the upper limit value (allowable rotation speed), the vibration-use hydraulic pump P2 is activated by the overspeed suppression mechanism 30 to reduce the rotation speed of the engine E. As shown with oil pressure L3 of the vibration-use hydraulic pump P2, vibration energy to vibrate the drum R at time t1 has a great leading edge. That is, a large amount of energy is required when the drum R is vibrated. In the present embodiment, the vibration-use hydraulic pump P2 is activated so that the energy input from the tire motor M1 and drum motor M2 to the engine E is consumed (taken away) by the vibration-use hydraulic pump P2, to reduce the rotation speed of the engine E.

At that time, the vibration-use hydraulic pump P2 is immediately stopped, and, as shown with rotation speed L2 of the vibration-use hydraulic motor M3, the rotation speed of the vibration-use hydraulic motor M3 is not significantly increased. That is, the drum R is not substantially vibrated. The operator can feel deceleration, but does not feel the vibration of the drum R. Incidentally, rotation speed L2*b* (shown by a dotted line) of the vibration-use hydraulic motor virtually indicates a state where the vibration-use hydraulic motor M3 is continuously activated. Similarly, oil pressure L3*c* (shown by a dotted line) of the vibration-use hydraulic pump P2 virtually indicates a state where the vibration-use hydraulic motor M3 is continuously activated.

As shown with the embodiment in FIG. 4, the vibration-use hydraulic pump P2 may be intermittently rotated normally to suppress overspeed of the engine E. Thus, even when the vibrating roller 1 rolls on a long downhill, for example, the overspeed of the engine E is efficiently reduced.

Meanwhile, when a downhill is long and steep, for example, there is a risk that overspeed of the engine E cannot be suppressed only by repeatedly activating the vibration-use hydraulic pump P2 to normally rotate, as in the embodiment shown in FIG. 4. That is, when the downhill is steep, a leading edge of the rotation speed of the engine E also becomes steep. Therefore, before the oil pressure of the vibration-use hydraulic pump P2 is completely lowered, the vibration-use hydraulic pump P2 needs to be activated again. In such a case, an amount of energy to be taken away from the engine E is small. Accordingly, there is a risk that the overspeed of the engine E cannot be effectively suppressed.

In such a case, the overspeed suppression mechanism 30 may be configured to cause the vibration-use hydraulic pump P2 to be intermittently rotated such that the rotation direction thereof is sequentially changed from normal rotation to reverse rotation, to normal rotation, and to reverse rotation. Thus, as compared with the case of repeating the normal rotation intermittently, the amount of energy taken away from the engine E is increased, to efficiently suppress the overspeed of the engine E.

Figure 5:
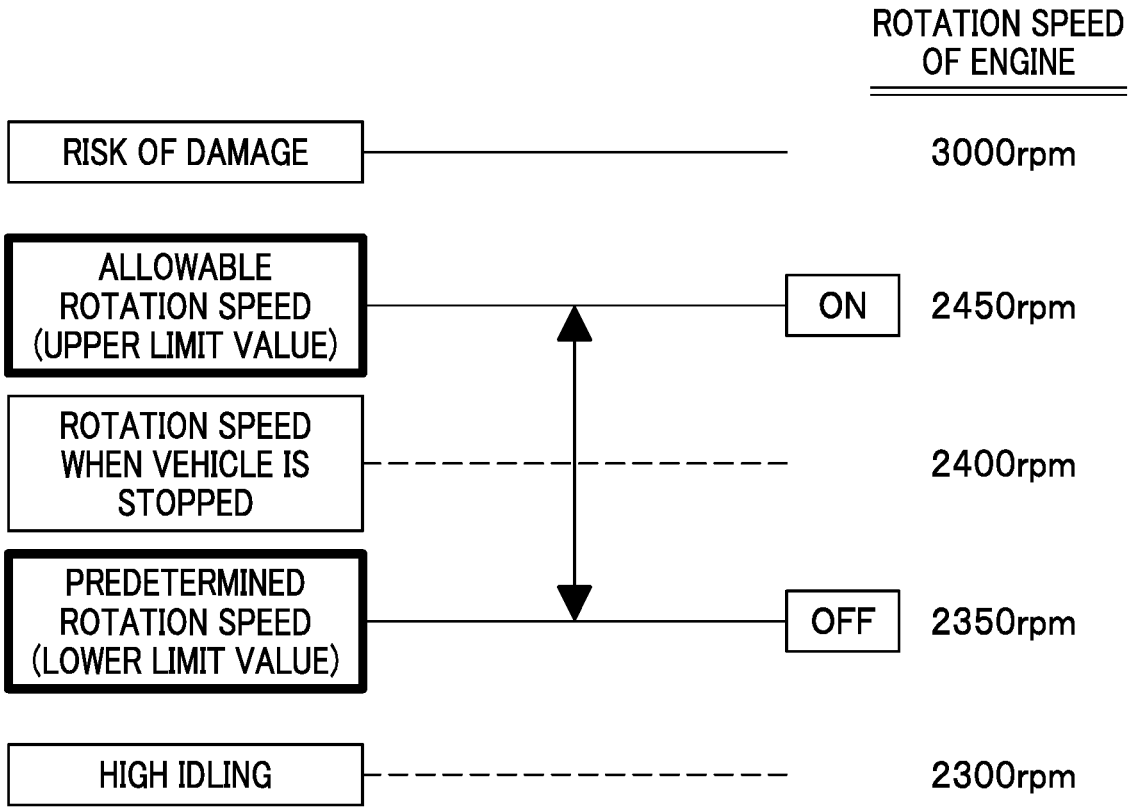
FIG. 5 is a conceptual diagram showing an example of setting up the overspeed suppression mechanism according to the present embodiment.

Next, a description will be given of an example of setting the upper limit value and lower limit value of the overspeed suppression mechanism 30. The numerical values indicated below are mere examples and do not limit the present invention. FIG. 5 is a conceptual diagram showing an example of setting up the overspeed suppression mechanism 30 according to the present embodiment. As shown in FIG. 5, in the overspeed suppression mechanism 30, the value to turn on the vibration-use hydraulic pump P2 ("allowable rotation speed" (upper limit value)) is preferably lower than "rotation speed (3000 rpm, for example) liable to damage the engine due to an overload" and is higher than "rotation speed (2400 rpm, for example) when the vehicle is stopped". The "rotation speed when the vehicle is stopped" is the maximum value when a load is applied to the engine E to momentarily increase the rotation speed of the engine E in a case where the vibrating roller 1 rolling at high idling on a flat road is stopped. The upper limit value is preferably set higher than the "rotation speed when the vehicle is stopped". That is, the vibration-use hydraulic pump P2 is preferably set so as not to be activated by the overspeed suppression mechanism 30 within a range of normal use of the vibrating roller 1.

Meanwhile, in the overspeed suppression mechanism 30, the value to turn off the vibration-use hydraulic pump P2 ("predetermined rotation speed" (lower limit value)) is preferably lower than the "allowable rotation speed", and higher than the "high idling." If the vibration-use hydraulic pump P2 is continuously activated, the drum R is fully vibrated. To prevent the vibration, the lower limit value of the overspeed suppression mechanism 30 is set. The "high idling" refers to a state of the engine E where the throttle lever R2 is shifted to the maximum. The vibrating roller 1 usually rolls with the throttle lever R2 being shifted to the maximum (full throttle). If the lower limit value is set lower than the "high idling", the rotation speed of the engine E cannot be decreased with respect to the rotation speed of the "high idling" so that the vibration-use hydraulic pump P2 is continuously activated. However, setting the lower limit value higher than the "high idling" as in the present embodiment allows the vibration-use hydraulic pump P2 to be securely stopped.

The values of the upper limit value and lower limit value of the overspeed suppression mechanism 30 may be appropriately set based on matching among a type of the construction vehicle, a type of the engine E, a type of the vibration-use hydraulic pump P2, a rotation moment of the drum R, a gradient of the downhill to be expected. Preferably, the values of the upper limit value and lower limit value of the overspeed suppression mechanism 30 are appropriately set within a range such that overspeed of the engine E is reliably suppressed, the operator does not feel vibration, and an undue burden (inertia force) does not act on the operator when the overspeed is suppressed.

According to the vibrating roller 1 of the present embodiment described above, the vibration-use hydraulic pump P2 (task-use hydraulic pump) is activated to consume the power as startup energy to reduce the power input to the engine E, so that overspeed of the engine E is suppressed. Further, as the existing vibration-use hydraulic pump P2 only has to be activated, the structure can be simple.

Further, the overspeed suppression mechanism 30 has a simple structure including the sensor 31 and determination unit 32. Therefore, manufacturing costs and a mount space can be small. Still further, the overspeed suppression mechanism 30 can be easily mounted to the existing vibrating roller 1 as an add-on.

Further, though a type of the task-use hydraulic pump may be appropriately selected, the task-use hydraulic pump in the present embodiment is the vibration-use hydraulic pump P2 to vibrate the drum R. A large amount of energy is required when the drum R is vibrated. The large amount of energy is consumed by the vibration-use hydraulic pump P2 to efficiently suppress the overspeed of the engine E. Still further, if the task-use hydraulic pump is a hydraulic pump to drive arms of a backhoe, for example, there is a risk that the arms may move in unintended situations. However, in the present embodiment, the energy is consumed as vibration energy inside the drum R so that adverse effects to the outside is minimized.

The embodiment of the present invention has been described above, but can be subjected to design change within the scope of the present invention. In the present embodiment, the vibration-use hydraulic pump P2 is used as task-use hydraulic pump, for example, but the present invention is not limited thereto. Other task-use hydraulic pumps provided in a construction vehicle, such as a watering pump and a cutter drum may be used.

Further, the drum R has one axle in the present embodiment but may have two axles. Still further, the overspeed suppression mechanism 30 is directly coupled to the vibration-use hydraulic pump P2, but a solenoid valve may be provided in the vibration-use hydraulic circuit Z2 to control the vibration-use hydraulic pump P2 by the solenoid valve. Yet further, in the present embodiment, the vibrating roller 1 including the drum R and tires T is shown, but may include the drums R on the front side and rear side, or tires T on the front side and rear side. Furthermore, a notification mechanism may be provided to notify that the overspeed suppression mechanism 30 is in operation to the outside by sound or light. In addition, the vibration-use hydraulic pump P2 may be a variable capacity type pump with a variable discharge amount or a fixed capacity type pump with a non-variable discharge amount.

EXAMPLE

Next, a description will be given of a usage example of the present invention. An overrun test was made with the vibrating roller 1. In the overrun test, a vibrating roller (SAKAI HEAVY INDUSTRIES, LTD. SV513) was used. In the overrun test, a vibrating roller without the overspeed suppression mechanism 30 (comparative example) and the vibrating roller 1 with the overspeed suppression mechanism 30 (usage example) were rolled on the same downhill, to measure oil pressure of the rolling-use hydraulic pump, oil pressure of the vibration-use hydraulic pump, and rotation speed of the engine, and to confirm an effect of suppressing the rotation speed of the engine. The vibrating roller 1 rolled with the throttle lever R2 in full throttle. The speed of the vibrating roller 1 with the throttle lever R2 in full throttle was about 10 km/h on a flat ground.

Figure 6:
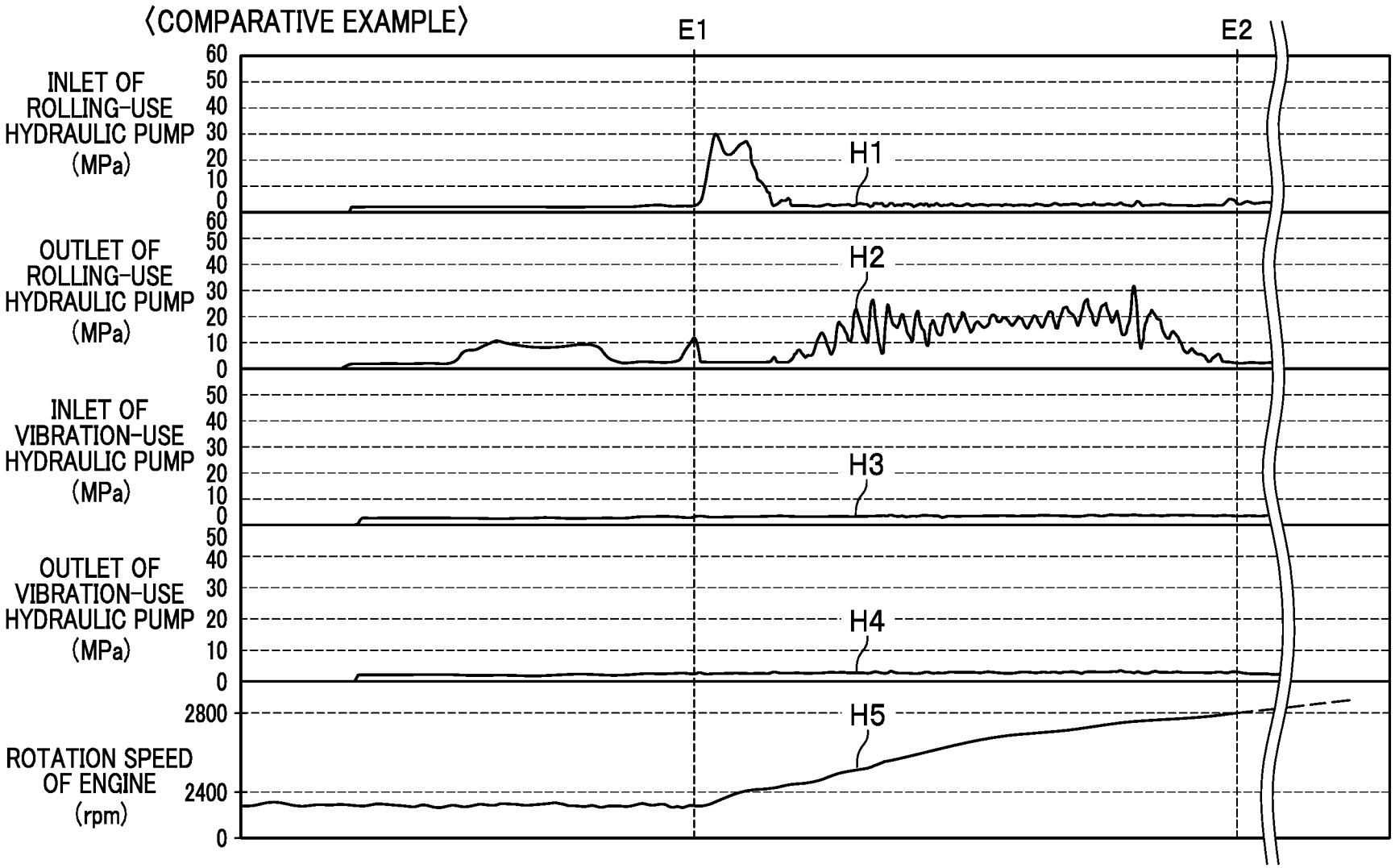
FIG. 6 is a graph showing oil pressure of a rolling-use hydraulic pump, oil pressure of the vibration-use hydraulic pump, and the rotation speed of the engine in a comparative example.
Figure 7:
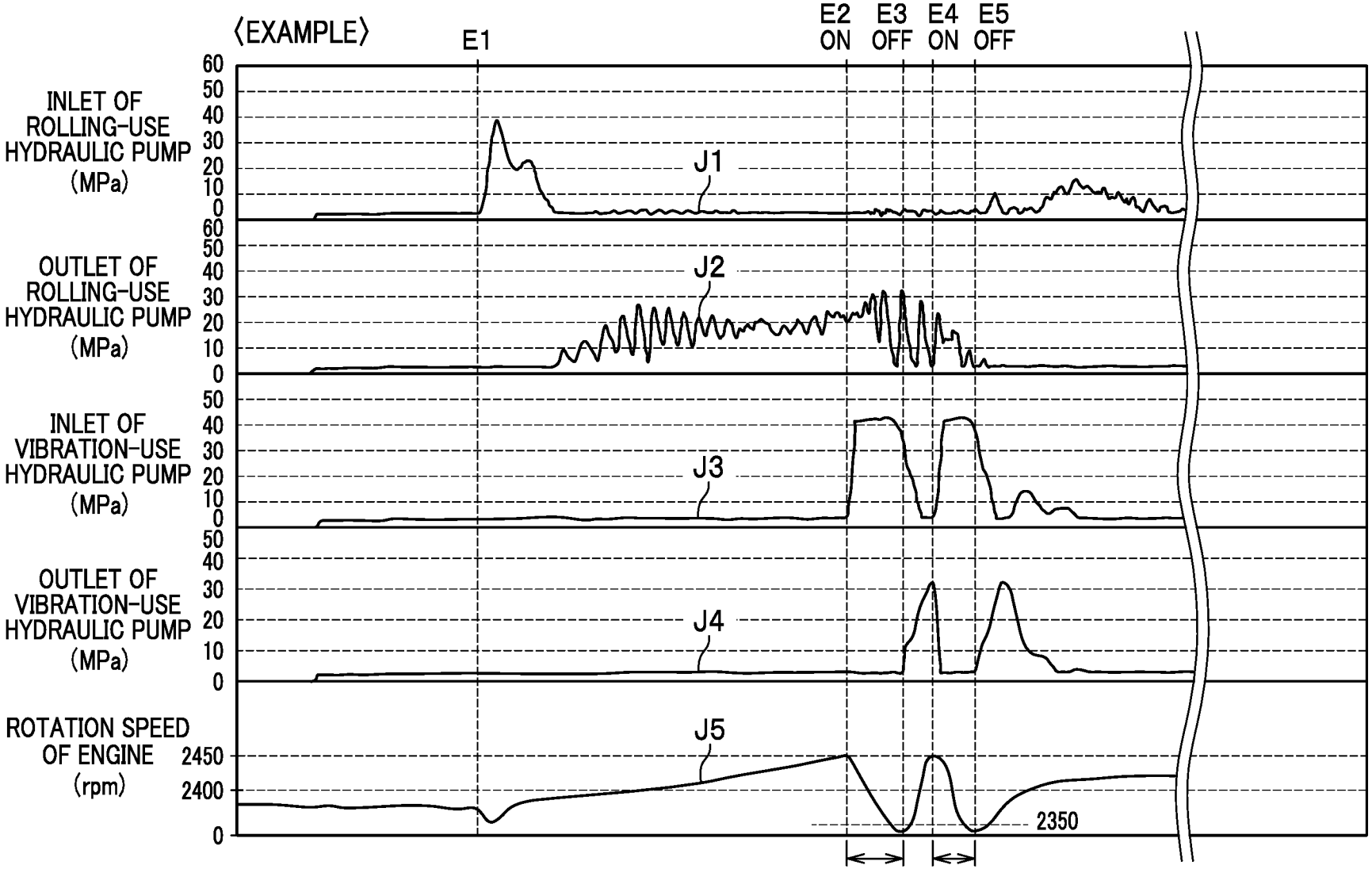
FIG. 7 is a graph showing the oil pressure of the rolling-use hydraulic pump, the oil pressure of the vibration-use hydraulic pump, and the rotation speed of the engine in the present embodiment.

FIG. 6 is a graph showing oil pressure of the rolling-use hydraulic pump, oil pressure of the vibration-use hydraulic pump, and rotation speed of the engine in the comparative example. FIG. 7 is a graph showing oil pressure of the rolling-use hydraulic pump, oil pressure of the vibration-use hydraulic pump, and rotation speed of the engine in the example.

A spot E1 shown in FIG. 6 is a position at which the vibrating roller began to roll on a downhill. In the comparative example, the vibrating roller rolled on a downhill with the vibration switch S1 being off, that is, the vibration-use hydraulic pump was not activated so that there was little change in oil pressure H3 and H4. In the comparative example, as shown with rotation speed H5, when the vibrating roller rolled to a spot E2, power was input from the rolling-use motor to the rolling-use hydraulic pump due to the fall of the vehicle. The engine was in overspeed by an amount which cannot be covered by engine brake power. The rotation speed increased up to 2850 rpm at the maximum.

In contrast, in the usage example, it was confirmed that overspeed of the engine E was suppressed as shown in FIG. 7. The spot E1 shown in FIG. 7 is a position at which the vibrating roller 1 began to roll on a downhill. In the usage example, the vibrating roller 1 rolled on a downhill also with the vibration switch S1 being off. The spot E2 and a spot E4 are positions at which the vibration-use hydraulic pump P2 was activated by the overspeed suppression mechanism 30, and spots E3 and E5 are positions at which the vibration-use hydraulic pump P2 was stopped by the overspeed suppression mechanism 30. In the usage example, the allowable rotation speed (upper limit value) was set to 2450 rpm. Further, the predetermined rotation speed (lower limit value) was set to 2350 rpm.

As shown with rotation speed J5, when the rotation speed of the engine E reached 2450 rpm, the vibration-use hydraulic pump P2 was activated by the overspeed suppression mechanism 30, and oil pressure J3 was increased. Energy was consumed by the activation of the vibration-use hydraulic pump P2 so that the rotation speed J5 of the engine E was decreased. When the rotation speed J5 of the engine E was decreased to the lower limit value, the vibration-use hydraulic pump P2 was stopped, and the rotation speed J5 of the engine E was increased from the spot E3 to the spot E4 again. When the rotation speed J5 of the engine E reached 2450 rpm, the vibration-use hydraulic pump P2 was activated again, and the rotation speed J5 of the engine E was decreased. As described above, in the overrun test, an effect of suppressing rotation speed by the overspeed suppression mechanism 30 was confirmed.

Incidentally, oil pressure while the roller is moving is about 17.5 MPa on average before the overspeed of the engine E occurs. The discharge amount of the rolling-use hydraulic pump P1 is 75 cc/rev, and hence a torque reversely input to the engine E is $T=75\times17.5/(2\pi)=208.89$ N·m.

Here, in case of estimating torque consumed for activating vibration when the drum R is vibrated, $\Delta P=33.5$ MPa based on the activation waveform, and the discharge amount of the vibration-use hydraulic pump P2 is 39.0 cc/rev. Accordingly, a torque to rotate the vibration-use hydraulic pump P2 is estimated as $T=39.0\times33.5/(2\pi)=207.94$ N·m. As described above, the torque input from a rolling system is approximately equal to the torque consumed in a vibration system before the overrun. Thus, it is confirmed by calculation that overspeed can be suppressed by activating vibration of the drum R.

REFERENCE SYMBOLS

1 vibrating roller, 2 base, 3 machine frame, 4 coupling part, 10 hydraulic device, 30 overspeed suppression mechanism, E engine, M1 tire motor, M2 drum motor, M3 vibration-use hydraulic motor, P1 rolling-use hydraulic pump, P2 vibration-use (task-use) hydraulic pump, R drum, X2 eccentric shaft, Z1 rolling-use hydraulic circuit, and Z2 vibration-use hydraulic circuit.

The invention claimed is:

1. A construction vehicle comprising:

a rolling-use hydraulic pump coupled to an output shaft of an engine and supplying hydraulic oil to a rolling-use hydraulic circuit;

a task-use hydraulic pump coupled to the output shaft of the engine and supplying the hydraulic oil to a task-use hydraulic circuit; and an overspeed suppression mechanism configured to, when the construction vehicle rolls on a downhill, activate the task-use hydraulic pump not in operation to suppress overspeed of the engine when a rotation speed equal to or greater than allowable rotation speed is applied from the rolling-use hydraulic pump, which is activated by the engine, to the output shaft of the engine, and configured to stop the task-use hydraulic pump when the rotation speed of the engine is equal to or less than a predetermined speed, wherein the overspeed suppression mechanism includes a sensor to detect the rotation speed of the engine and a determination unit which determines if the rotation speed detected by the sensor is equal to or above the allowable rotation speed and if the rotation speed detected by the sensor is equal to or less than the predetermined rotation speed, and which, and sends an activation signal to the task-use hydraulic pump when the detected rotation speed of the engine is equal or above the allowable rotation speed and sends a stop signal to the task-use hydraulic pump when the detected rotation speed of the engine is equal to or less than the predetermined rotation speed.

2. The construction vehicle as claimed in claim 1 further comprising a drum having an eccentric shaft therein and configured to compact a compacted surface, wherein the task-use hydraulic pump rotates the eccentric shaft to vibrate the drum.

3. The construction vehicle as claimed in claim 2, wherein the overspeed suppression mechanism intermittently rotates the eccentric shaft in the same direction.

4. The construction vehicle as claimed in claim 2, wherein the overspeed suppression mechanism rotates the eccentric shaft in a normal direction and a reverse direction.

5. The construction vehicle as claimed in claim 1, wherein the allowable rotation speed is set higher than the maximum rotation speed of the engine when a vehicle rolling at high idling is stopped.

6. The construction vehicle as claimed in claim 1, wherein the overspeed suppression mechanism stops the task-use hydraulic pump when the overspeed of the engine is suppressed to have rotation speed of the engine equal to or less than a predetermined rotation speed, and wherein the predetermined rotation speed is set higher than rotation speed at high idling.

* * * * *